US005979535A

United States Patent [19]

Sakamoto et al.

[11] Patent Number: 5,979,535

[45] Date of Patent: Nov. 9, 1999

[54] METHODS FOR SEMI-MELTING INJECTION MOLDING

[75] Inventors: Kazuo Sakamoto; Yukio Yamamoto; Kyoso Ishida, all of Hiroshima, Japan

[73] Assignee: Mazda Motor Corporation, Hiroshima, Japan

[21] Appl. No.: 09/046,687

[22] Filed: Mar. 24, 1998

[30] Foreign Application Priority Data

Mar. 27, 1997 [JP] Japan ..... 9-094800

[51] Int. Cl.[6] ..... B22D 17/00; B22D 17/04

[52] U.S. Cl. ..... 164/113; 164/312

[58] Field of Search ..... 164/113, 312, 164/119, 120

[56] References Cited

U.S. PATENT DOCUMENTS

| | | | |
|---|---|---|---|
| 5,040,589 | 8/1991 | Bradley et al. | 164/113 |
| 5,287,719 | 2/1994 | Moritaka et al. | 72/364 |
| 5,501,266 | 3/1996 | Wang et al. | 164/113 |
| 5,680,894 | 10/1997 | Kilbert | 164/312 |

FOREIGN PATENT DOCUMENTS

| | | |
|---|---|---|
| 0 409 966 B1 | 3/1995 | European Pat. Off. . |
| 0 710 515 A1 | 5/1996 | European Pat. Off. . |
| 0 755 738 A1 | 1/1997 | European Pat. Off. . |
| 1-309717 | 12/1989 | Japan . |
| 7-256427 | 10/1995 | Japan . |

OTHER PUBLICATIONS

"Thixmolding of Magnesium alloys with high solid fraction", Ken Saito et al., The proceedings of the spring conference, Society of Light Metal of Japan, pp. 3–4, 1996.

"Thixomolding process of Magnesium Alloy", Kazuo Kitamura, The Japan Steel Works, Ltd., Sokeizai, pp. 1–7, May 1995.

Patent Abstracts of Japan, Sakamoto Kazuo, Publication No, 09038758, Feb. 10, 1997 "Half–Molten Metal Injection Forming Device and Method Thereof".

K. Saito, "Thixocasting von Magnesiumlegierungen", pp. 86–91.

*Primary Examiner*—Patrick Ryan

*Attorney, Agent, or Firm*—Sixbey, Friedman, Leedom & Ferguson, P.C.; Donald R. Studebaker

[57] ABSTRACT

The invention provides a method for injection molding a semi-molten melt of metal to a product, wherein a semi-molten melt of metal is injected into a cavity of the mold through a nozzle of injector to mold the product which is divided in a lower solid fraction portion to require strength and a higher solid fraction portion to require molding accuracy along flow of the melt inside the cavity. In the method of the invention, a part of the melt to be earlier injected is determined to be at a lower temperature in the injector than a part to be later injected among the melt parts composing said lower and higher solid portions in the cavity by injecting a batch of the melt, and that the melt is injected into the cavity on the side on which said lower solid fraction portion for the strength of the product is formed.

7 Claims, 5 Drawing Sheets

Solid Fraction 10%

300μm

Solid Fraction 2%

300μm

METHODS FOR SEMI-MELTING INJECTION MOLDING

FIELD OF THE INVENTION

The present invention relates to a method for injection molding semi-molten melt of metal, to an apparatus for injection molding semi-molten melt of metal, and to products produced by the method.

BACKGROUND OF THE INVENTION

There are known methods for forming products from semi-molten metal as methods of producing high quality products. The following methods for using the semi-molten melt are adopted:

Semi-melting forging method is to forge material in the semi-melting state between forging molds or dies to shape and cool a product.

Semi-melting casting method is a method of casting by injecting a semi-molten metal from a sleeve of a high pressure casting machine. In the process the semi-molten melt is prepared previously in some furnace from a billet as a material, carried to the sleeve, and injected from the sleeve into the casting mold.

Semi-melting injection molding method is known as a method of injecting into a mold a semi-molten metal which is prepared in the desirable semi-molten state inside a injector and pressurized by the very injector to mold a product with desired shape in a cavity of the mold. In this method, the melt is prepared to be in a semi-melting state (i.e. in a state mixing of a liquid phase and a solid phase in a metal or alloy) inside the injector by heating and melting the powdered or pelletized metal material in the temperature-controlling cylinder of the injector. The melt is pressurized by the screw toward a nozzle attached to an end of the cylinder and injected into a cavity inside the mold in connection to the nozzle.

This semi-melting injecting molding method has been provided aluminum and magnesium metal/alloy products with high quality and less defect.

In the prior art regarding the semi-melting casting, Japanese Patent Publication No 7-256427 A discloses a method of pouring the melt in the semi-molten metal in a sleeve which is provided close to and passing through the cavity and injecting the melt pressurized by a plunger from the sleeve into the cavity. In the prior art the method can pressurize the melt in the cavity partially by the plunger to overflow into a basin past the cavity through so narrow pass as to filtrate grains of the solid phase in the melt. Thus, the remaining melt in the cavity by filtration has partially higher solid fraction than one in another portion of the cavity. This process can control to differ the solid fractions in some portions of the molded product.

Some cast or molded products such as mechanical components are often required to be provided with different properties in their different portions. Such properties are dimensional accuracy, mechanical property including tensile strength of the product, and the like.

To meet the request there have been used the way of setting the solid fraction of each portion to desired different value, the different solid fractions changing the metal microstructure of each portion in the metal product after solidified.

Solid fraction of melt has been found to have a relation with shrinkage of cast during solidifying of the metal. FIG. 5A shows that a magnesium alloy cast decreases in dimension change due to shrinkage as the solid fraction of the alloy melt increases and that high solid fraction is required in a portion in which high molding dimensional accuracy is requested for the product. In general, the semi-molten melt contains a solid phase as grains which are dispersed in the liquid metal. As the melt is poured into a mold, the liquid part of the melt supplied is solidified in a cavity of the mold, and the solid fraction formed previously can reduce the shrinkage of the metal product because solid phase dose not almost reduce in volume during solidification. Thus the semi-melting injection method allows the product to obtain high dimensional accuracy.

Solid fraction of the semi-molten melt also have a relation with ultimate tensile strength of the product. FIG. 5B shows that a magnesium alloy product tends to decrease in as-cast tensile strength as the solid fraction in the alloy melt increase. It can be seen that a low solid fraction in the melt is needed to enhance the mechanical property in the strengthening portion of the cast product.

Thus, in the methods employing the semi-molten metal, the solid fraction should be set in each portion in a product in a particular, different value according to the required property for each portion of the product.

However, the prior-art method mentioned above has a disadvantage as follows; the method of using the pressurizing the melt locally in the cavity can manage to vary the solid fractions between the flow range of the pass to the partial pressurized portion and other portion in the cavity, but the locally pressurizing a melt outside the cavity is attended with difficulty of controlling the desired solid fraction in a wide range quantitatively in the desirable portion of the product, and also reduction in yield of production due to the plunger pushing out a part of the melt. The mechanism is also much complicated by arrangement of the sleeve and the plunger movable in it near the cavity of the mold.

SUMMARY OF THE INVENTION

An object of the present invention is to provide a method for semi-melting injection molding to accurately control a solid fraction in each portion divided in the cavity of the mold, i,e, in each portions of a solid product molded in the cavity, corresponding to the properties which are requested in the potions of the product.

Another object of the present invention is to provide an apparatus for semi-melting injection molding to be able to precisely control a solid fraction each portion of the cavity i,e, in each portions of the solid product molded in the cavity, corresponding to the properties which are requested in the potions of the product.

To attain the objects, the present invention determines appropriate relation between a injecting order of a melt with the different temperatures along the injecting flow and arrangement of portions divided in a cavity into which the melt is injected, according to property required in each portion of a product.

To this end, the method of the invention is to prepare a batch of semi-molten melt to have different temperatures in an injector along the flow of the melt to be injected by the injector into a cavity of a mold, using a relation between a temperature of the melt and a solid/liquid fraction in the melt in regard to an alloy to be used, the melt being controlled at different solid fraction required in each portion of the cavity.

The method of semi-melting injection molding generally comprises steps of preparing a batch of semi-molten melt of a metal in a cylinder of the injector by heating the metal material to control the temperatures of the melt and injecting into a cavity in a mold the melt which is pressurized by the injector to mold a metal product. In the method of the present invention, in the melt-preparing step, above, the melt is controlled at a different predetermined temperature in each part by heating zones divided along the cylinder so as to set a desired solid fraction each part, and in the injecting step the parts of the melt are injected continuously and molded into portions divided in the cavity to obtain a main property in each portion of the product corresponding to a solid fraction of each part of the melt.

To attain the other object, the apparatus of the invention comprises a heat-controlling cylinder to form the semi-molten melt at different temperatures (distribution) along flow of the melt which should be injected by a injector into a mold, and to determine a different solid fraction of the metal to require in each portion of a cavity of the mold, using the relation between a temperature of the melt and a solid/liquid fraction in the melt.

The apparatus of the invention comprises a heat-controlled cylinder for preparing the semi-molten melt of a metal in a cylinder of an injector by heating to control the temperatures of the melt; and a mold with a cavity into which the melt injected to mold a metal product, wherein the cylinder has heaters surrounding the outside to form heating zones divided inside along the cylinder from a nozzle toward the rear end, the melt being controlled at a different predetermined temperature in each part of the melt by the heating zones to set a desired solid fraction each part, and the mold has portions in the cavity divided to obtain a main property in each portion of the product corresponding to each solid fraction of the part of the melt certain products when manufactured by injection molding may require different desired characteristics or properties of material in their as-cast form, at different portions of the same product. These desired, yet differing properties are (1) High Tensile Strength and 92) Lease amount of distortion or shrinkage to avoid Machining operation. In the example of the Orifice Holder, the head needs High Tensile Strength while the threaded portion of the same item needs least amount of shrinkage or distortion to avoid machining operations. In order to achieve High Tensile Strength, the Solid Fraction in the melt has to be relatively low in the portion within the mold cavity corresponding to the head portion of the Orifice Holder so that on cooling during solidification there may be some shrinkage but the desired high strength is not sacrificed. Conversely, the screw portion of the same Orifice Holder require the other property i.e. to avoid machining. In this case, the shrinkage has to be minimal during solidification. Therefore, the solid fraction in that particular portion of the melt in the mold cavity corresponding to the threaded portion should be high which requires that the melt temperature in the corresponding zone of the injector to be comparatively lower.

The present invention includes products molded by a method of injection molding semi-molten melt through a nozzle of an injector into a mold, wherein solid fractions in the product differ along flow of the melt to be injected.

Particularly, in the product, a lower solid fraction portion is a portion to require strength of the product compared with a higher solid fraction portion, and the higher solid fraction portion is a portion to require molding accuracy of the product compared with the lower solid fraction portion.

BRIEF DESCRIPTION OF THE DRAWINGS

The invention is explained, below, in detail with reference to the drawings, in which.

EMBODIMENT OF THE INVENTION

In the method of the invention, a batch of semi-molten melt of metal is prepared in a injector and injected into a cavity of a mold by the injector to mold a product, and the cavity is designed previously to be divided in a lower solid fraction portion to require strength and a higher solid fraction portion to require molding accuracy along a flow of the melt inside the cavity.

In the injector, parts of the melt to be injected are determined to be at different temperatures in the injector to compose said lower and higher solid portions of the melt. The melt is injected into the cavity on any one of sides close to said lower and said higher solid fraction portions to fill said lower solid fraction of the cavity with the higher temperature parts of the melt and to fill said higher solid fraction with the lower temperature parts of the melt.

Particularly, in this method for injection molding a semi-molten melt of metal, a part of the melt to be early injected may be determined to be at a lower temperature in the injector than a part to be late injected in the melt parts to compose said lower and higher solid portions respectively in the cavity by injecting a batch of the melt, and that the melt is injected into the cavity on a side on which said lower solid fraction portion for the strength of the product is formed.

On the other hand, a part of the melt to be early injected may be determined at a higher temperature in the injector than a part to be late injected in the melt parts, and the melt is injected into the cavity on a side on which said higher solid fraction portion for formation accuracy of the product is formed.

The apparatus of the invention is an apparatus for injection molding a semi-molten melt of metal to a product, wherein a semi-molten melt of metal is injected into a cavity of the mold through a nozzle of a injector to mold the product, the cavity being divided in a lower solid fraction portion which is a portion to require strength and a higher solid fraction portion which is a portion to require molding accuracy along flow of the melt inside the cavity. The apparatus is characterized in that said nozzle is connected to the cavity on any one of sides on which the lower solid fraction and higher solid fraction portions are to be molded, and that melt parts to be early injected and to be late injected are determined to be at different temperatures by heaters around the cylinder so that the higher temperature and lower temperature parts of the melt are filled with the lower and higher solid portions of the cavity respectively by injecting.

Figure 1A:
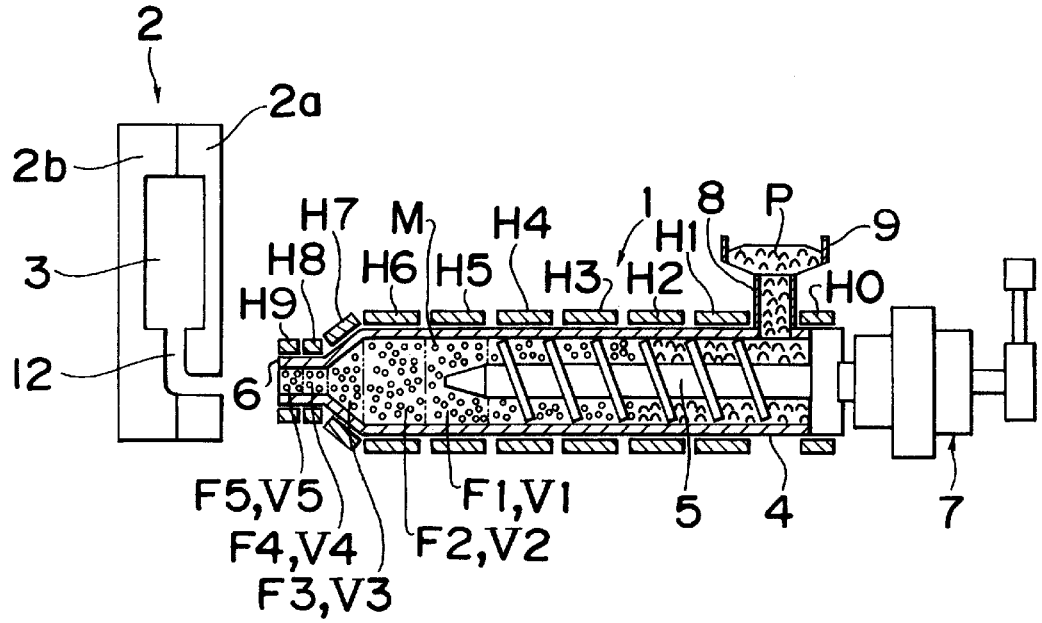
FIG. 1A shows a vertical cross-sectional view of an apparatus comprising a injector and a mold, using the method in the invention.

In an embodiment of the invention, the apparatus for the semi-melting injection molding method of the invention, as shown in FIG. 1A, comprises a mold 2 to mold a semi-molten melt in a desirable shape, and an injector 1 for melting metal material to the semi-molten melt and injecting it into the mold 2.

The injector is provided with a cylinder having a screw 5 fixed around a shaft rotatable and movable longitudinally inside the cylinder 1, a nozzle 6 which is attached to a front end of the cylinder to connect to a mold for injection and a plurality of heaters H0–H9 as a heating means are arranged around the cylinder.

The screw has functions to carry the material in the suitable place inside the cylinder to heat it and pressurize the heated melt toward the nozzle. Therefor a motor to rotate the screw and an actuator 7 to move it back and forth are connected to the screw shaft at the opposite end of the cylinder.

The plurality of heaters H0–H9 are divided longitudinally along the axis of the cylinder in order to control the heating of the melt which is divided into a plurality of heating zones along the cylinder. The heaters may be controlled individually by power controllers (not shown) to determine temperatures required in divided parts of the melt by the heating zones.

At the rear end of the cylinder are provided a hopper for feeding metal material into the rear end inside the cylinder through a gas-replacing room filled with nonoxidizing gas such as argon. The gas-replacing room allows the material charged into the cylinder to place in the nonoxidizing atmosphere to prevent the material from oxidizing.

The method of the invention may use aluminum alloys and magnesium alloys as metal. In this example, The metal material takes shape of chipped pellets of a strontium-containing magnesium alloy (ASTM AZ91D alloy), which are chipped from deformed blocks of the alloy having adequately prepared chemical composition.

Figure 1B:
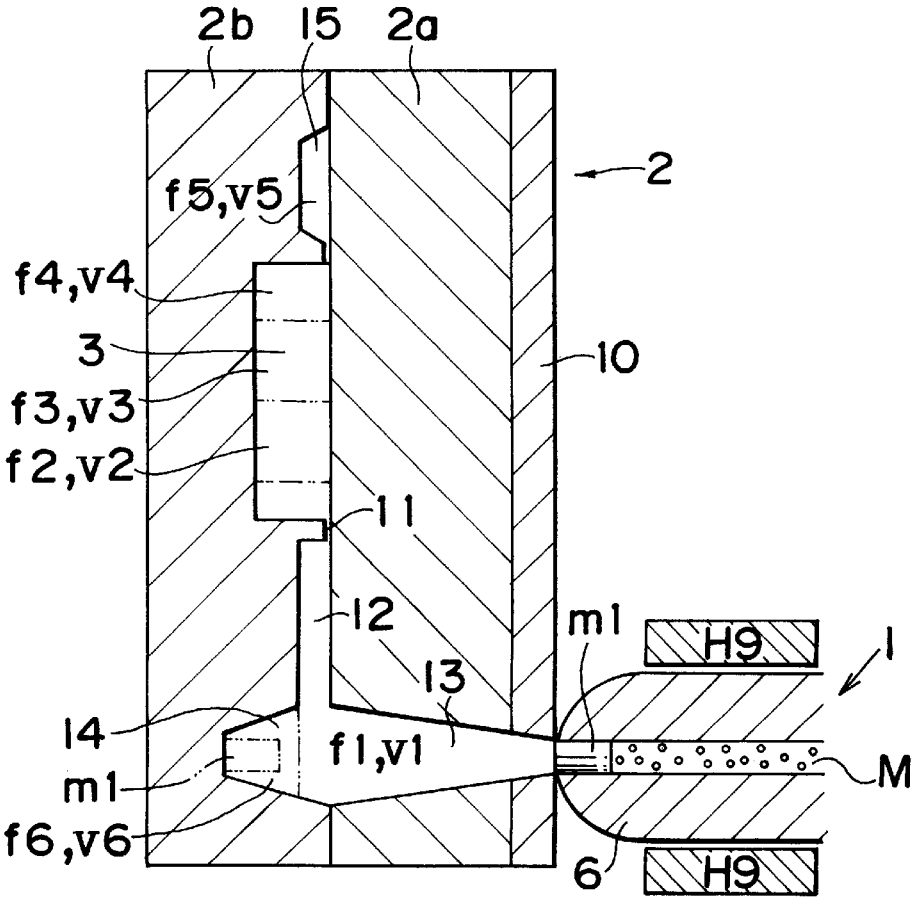
FIG. 1B shows a vertical cross-sectional view of a mold with a cavity divided in several portions with volumes corresponding to heaters in shown FIG. 1A.

On the other hand, the mold, above, comprises a fixed half-mold 2*a* attached to the a vertically stationary plate 10 and a movable half-mold 2*b* capable of facing in contact to or separating from the fixed half-mold. In the facing surfaces halves of a molding cavity 3 and a passage 11 to 13 are sculptured and the two half-molds fit together to a single mold to form a cavity inside for shaping the melt to a product. As shown in detail in a enlarged view of FIG. 1B, the passage comprises gate 11, a runner 12, and a spool 13 formed inside which are a passage of the melt injected from the nozzle 6 of the injector to the cavity 3.

In the mold space comprising two concaves is provided for capture of the first injected melt into the mold. A first concave 14, which is referred to as "plug catcher", is shaped in a way of the passage between the cavity 3 and the nozzle 6. In this case, the plug catcher 14 is formed at the opposite end to the nozzle 6, and is opened at a low flowing level to the direction of the spool 13 so as to trap the melt-frozen metal m1, termed plug, which have left in a opening of the nozzle 6 after the preceding injection, preventing the plug from entering the cavity when next injecting. The plug catcher is preferably formed to be in volume large enough to capture the plug and a part of the melt injected following the plug.

A second concave, which is referred to as "overflow groove, is formed in the mold so as to connect to the most interior of the cavity, trapping a part of the melt which is injected following said melt-frozen metal, the plug.

Thus, the first and second concaves compose space outside the cavity in the mold, and when injecting, the space may be capable of accepting the earliest injected melt part which is left in the nozzle.

Figure 5A:
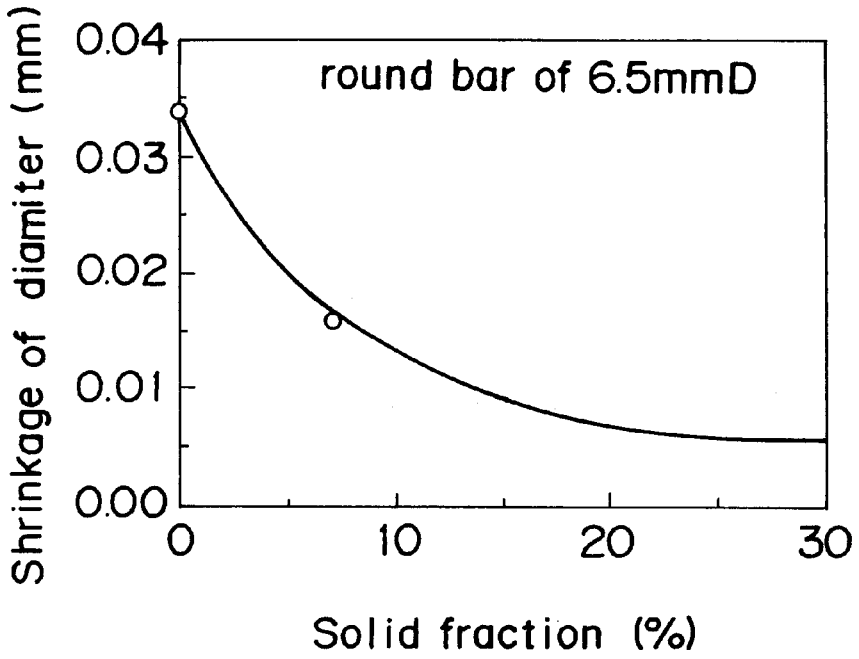
FIG. 5A is a graph showing a relation between solid fraction and shrinkage of a diameter during molding in diameter 6.5 mm of a round bar molded of a magnesium alloy.
Figure 5B:
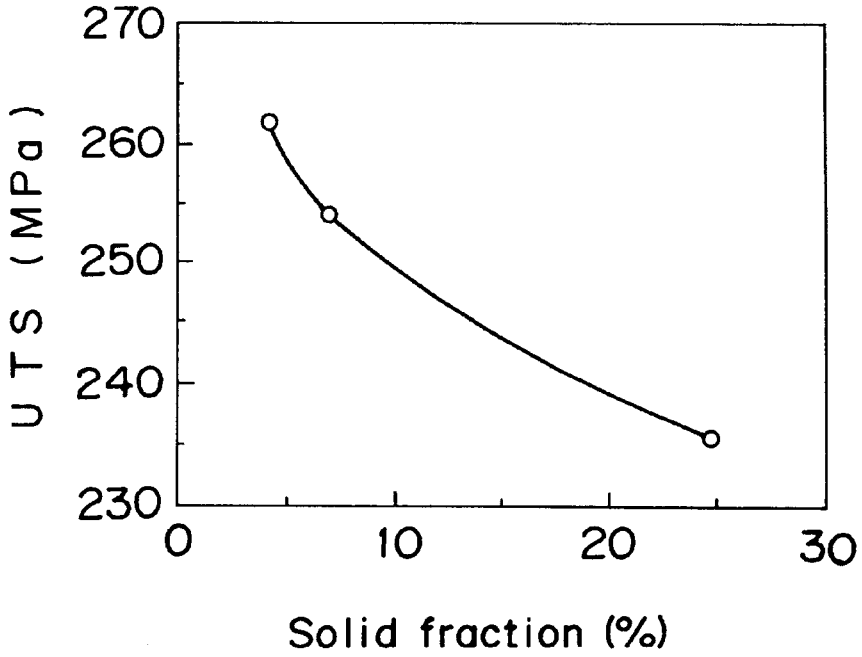
FIG. 5B is a graph showing a relation between a solid fraction and ultimate tensile strength (UTS) of a magnesium alloy.

A product to be molded using this apparatus may change in solid fraction along the flow of the melt injected in the mold. In the product, a lower solid fraction portion which is a part of the metal with low fraction causes the potion of the product to have higher strength, and a higher solid fraction portion made of a part which is a part of the metal with high fraction causes the portion to have higher molding accuracy, i,e, lower shrinkage during solidification (see FIGS. 5A and 5B). For the purpose, as said nozzle is connected to the cavity corresponding to a side of the cavity where the lower solid fraction portion which requires strength is molded, the early injected part of a batch of the melt is determined to be at a lower temperature than the later injected part following.

Alternatively, as the nozzle of the injector is connected to the mold corresponding to a side of the cavity where the higher solid fraction portion which requires formation accuracy is molded, and that the earliest injected part of a batch of the melt is determined at a higher temperature than the later injected part following.

Thus, The product may have high strength in the low solid fraction portion and high formation accuracy in the high solid fraction portion according to the flow of the semi-molten melt during injection.

To this end, the flow of the melt to be injected is divided in several parts corresponding to required properties for each portion for a product, and the divided parts of the melt are heated individually in the heating zones corresponding the heaters H0–H9 in the cylinder and controlled at the predetermined temperature each corresponding to the solid fractions.

This method uses a relation between a solid fraction of the semi-molten metal (the rest being liquid fraction) and a temperature of the metal, wherein the temperature is determined as the solid fraction is defined in a fixed value. As the solid fraction in the melt decreases with increase in a temperature within the solidus and liquidus curves which are defined by the chemical composition of the alloy to be used. If any portion of the product requires a higher solid fraction corresponding to particular accuracy thereof, the temperature of the part of the melt for the portion can be determined to be lower, and if a lower solid fraction to strength, the temperature to be higher. In this method it is necessary that the melt is heated to control the predetermined temperature of each part of the melt and injected into the mold so that the part of the melt forming the lower solid fraction portion, which is a portion with strength needed in a product, is determined to be at higher temperature than the part of the melt forming the higher solid fraction portion, which is another portion of the product with molding accuracy needed.

Furthermore, the interior of the cylinder is divided into a plurality of heating zones corresponding to the divided heaters H9–H5 from the nozzle 6 toward the rear end of the cylinder, wherein the heating zones H9–H5 are located in front of the top of the screw when it is withdrawn backward, and have a screw stroke of one batch of amount of the melt.

Providing that a solid fraction in a part of the melt in each zone is defined as F1 to F5 in order from on the rear end side up to the nozzle 6, that a volume in a part of the melt of each zone as V1 to V5 in the same manner, that further a solid fraction of a part of the injected melt in each portion divided in the mold is defined as f1, f6, and f2 to f5 in order from upstream to downstream of the melt injected in the mold, and that a volume of each portion divided in the mold as v1, v6, and v2 to v5, then each of the heating zones may be designed to have a volume according to the relations of V1=vi, V2=v2, V3=v3, V4=v4, and V5=v5+v6, and prior to injection, may be controlled to determine the temperature by the heaters H9 to H5 so as to meet such a relations as F1=fi, F2=f2, F3=f3, F4=f4, and F5=f5+f6.

In this case, for the nozzle it will be disadvantageous that the solid fraction in the nozzle with the heating zone heated by the heater H9, may be higher than expected, because the heater H9 around the nozzle is set at lower temperature to form the plug in the opening of the nozzle, and further the metal temperature inside the end of the nozzle tends to decrease below the predetermined temperature by affect of the mold temperature by contact of the nozzle to the mold injecting. Therefor, in this embodiment, in order to prevent the part of the melt in this heating zone from entering the cavity 3, i,e, the product, a volume v6 of the first concave 14 mentioned above is determined to be greater than the volume of the melt-frozen metal m1 left in said nozzle. Although a part of the melt in the heating zone behind the nozzle 6 is to be controlled at a temperature by the heater H9, it is apt to be affected by the low melt temperature at the end of the nozzle 6 so that this part of the melt have a tendency of high solid fraction. This part of the melt may be trapped by the first and second concaves mentioned above by holding a relation of V4+V5=v4+v5, so that this part of melt can be removed from the cavity. It is preferable to select the relation of V4=v4 and V5=v5 to lower wastage of the material.

Furthermore, If a portion of the product to not require particular strength may be molded in the cavity on the side of the second concave, the part of the melt with higher solid fraction in the top end of the nozzle can be poured into the cavity by the setting of the relation of V5>v5, and this can improve yield of a product to the needed material.

There is explained, below, a process of molding a product provided with different solid fractions in different portions therein by using a method of semi-melting injection molding as constructed above.

The process to conduct the method of the invention includes the following steps;

(1) fastening the half-molds to set a single mold, and connecting the nozzle of the injector with an opening of the spool of the mold;

(2) charging one batch of pellets of the magnesium alloy (for example, ASTM AZ91D cast alloy) as material into the hopper and feeding it into the cylinder through the gas-replacing room, then carrying the material inside the cylinder toward the nozzle by rotating the screw, and in this interval, heating any of parts of the material into semi-molten melt within the divided heating zones at predetermined temperature for each part;

While the material is advancing to the nozzle, the screw is withdrawn backward closer to the rear end, compulsory by using the actuator, and one batch of the material is hold to heat between the nozzle and the screw, as shown in FIG. 1A.

Figure 2A:
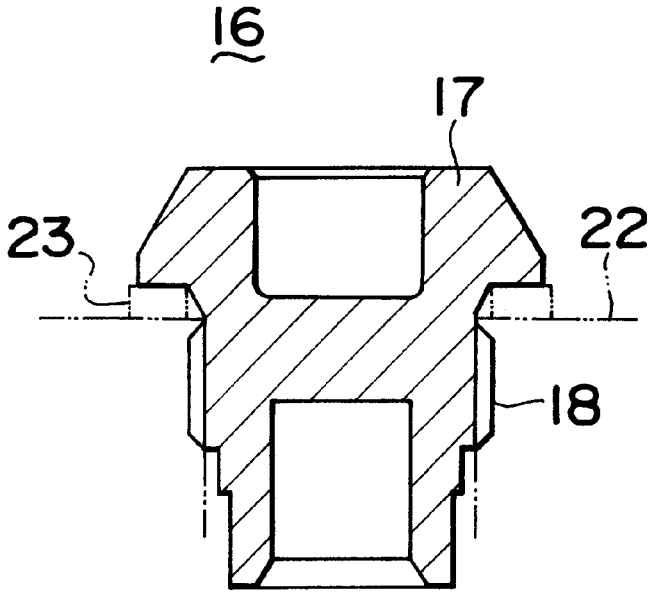
FIG. 2A shows a vertical cross-sectional view of a orifice holder for application of the invention.
Figure 2B:
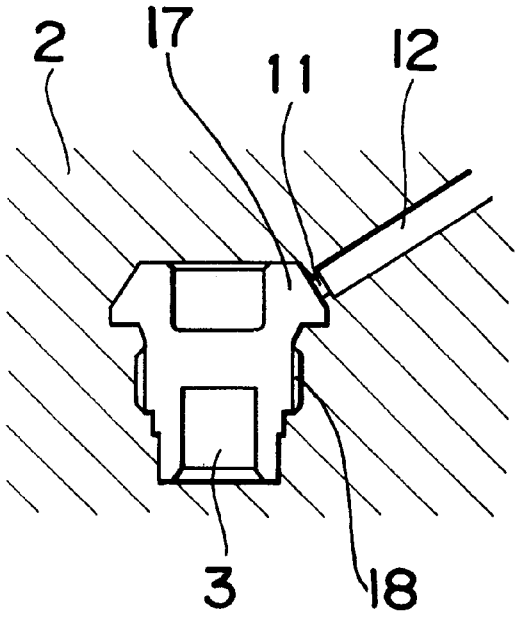
FIG. 2B shows a cross-sectional view of the mold, showing a relation of connecting a gate to a cavity, for molding the orifice holder as shown in FIG. 2A.

In this example, a product to be mold is an orifice holder 16 for a connecting component used for automatic transmissions for automobiles is shown in FIG. 2A. The orifice holder 16 comprises a head portion 17 and a threaded portion 18, and the head portion 17 is a portion to require strength, on which the fitting torque act as it is fitted tight, so that the threaded portion is needed to be at low solid fraction in the part of the melt. The threaded portion dose not need strength particularly, but is desired to be formed available as molded, without threading work and other machining to reduce manufacturing steps. In this view, the threaded portion should be a portion which requires molded accuracy and should have the higher solid fraction. In forming a mold, a cavity is shaped so that a gate is located so as to connect to the head portion of the orifice holder, a gate being an inlet of the melt to the cavity past a runner.

In the case of the orifice holder a heater H7 is controlled to be at 600° C. of temperature in the melt, and other heaters H8 and H9 are at 530° C., in the case of the magnesium alloy. Thus a part to be early injected in one batch of the melt can be determined at a lower temperature than the part to be late injected following the first injected melt.

Figure 4:
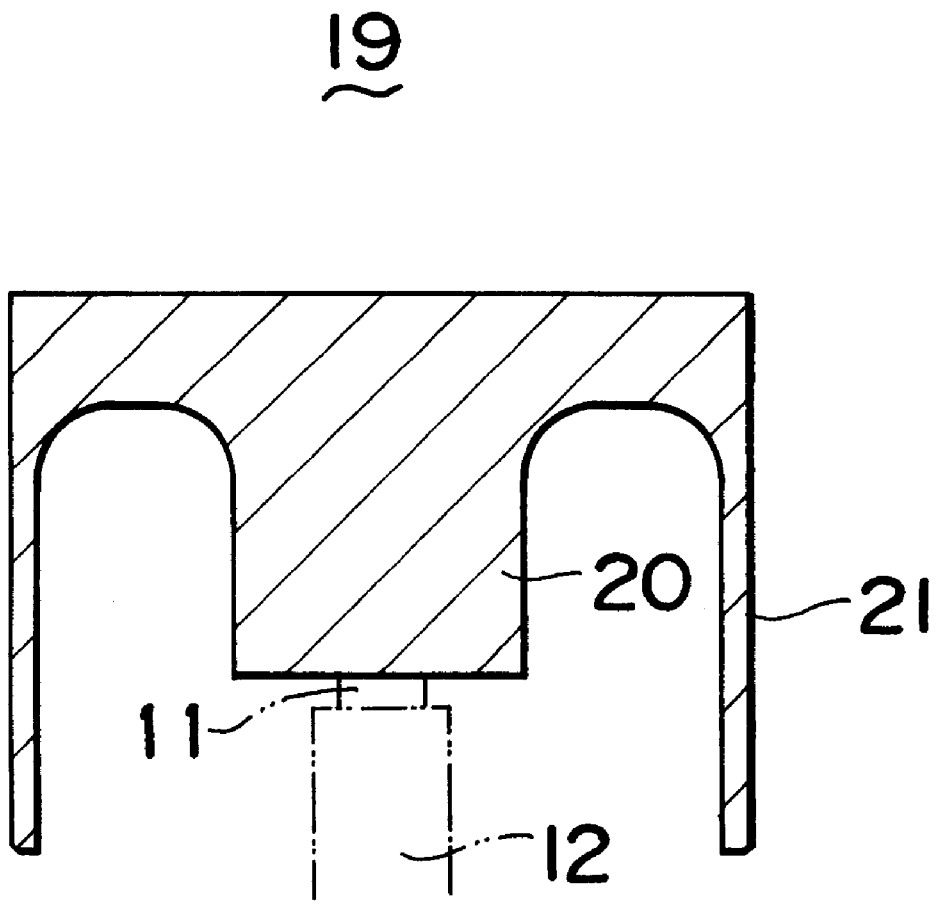
FIG. 4 shows a cross-sectional view of a valve tappet.

In another example, as shown in FIG. 4A, a valve tappet 19, which is a valve component of engines, can be listed. It has a thick center portion of the tappet which requires strength and should be a lower solid fraction portion, and thin outer ring portion which requires molding accuracy and is needed to be a higher solid fraction portion. In forming the mold, the gate is shaped in the mold to connect the thick portion of the tappet as shown by dotted-dash bar line in FIG. 4 in forming the mold. Also, heating zone H7 is determined to be at the temperature of 600° C., and the other heating zones H8 and H9 at the temperature of 530° C. Thus, a part to be earliest injected in one batch of the melt can be determined at a lower temperature than the part to be later injected following the first injected melt.

(3) moving the screw backward away from the nozzle by a predetermined stroke by the actuator after posing rotating it. The actuator can detect the stroke by which the screw have withdrawn, while the drawn stroke can measure the amount of one batch of the melt to require for an injection;

(4) moving the screw forth toward the nozzle by activating the actuator and pressurizing the melt out of the nozzle to the mold to be injected into the cavity through the passage, this causing the melt to be injected in the cavity on the side on which the lower solid fraction portion is formed, which is a portion to require strength in the product;

During injection, the first concave traps a melt-frozen metal m1 left in the opening of the nozzle after the preceding injection and also a part of the melt corresponding to a volume V5 inside the cylinder. The rest of the melt in the same volume 5 is trapped in the other second concave past the cavity.

Thereafter, the part of the melt corresponding to the volume V4 in the cylinder streams into the portion v4 of the cavity 3, the volume V3 into the portion v3 of the cavity 3, the volume V2 into the portion v2 of the cavity, and the volume 1 into the space v1 composed to the rest of the cavity, gate 11, runner 12 and spool 13 in series.

This method is to exclude the supercooled melt in the two concaves out of the cavity and dose not form the higher solid fraction in the cavity than expected solid fraction, so that it can ensures the resulting product to have required properties such as strength.

Reversely, the heating zone by the heater H7 may be set to be at lower temperature than the zone by the heaters H8 and H9. In this case, a part to be earliest injected in one batch of the melt can be determined at a higher temperature than the part to be later injected following the first injected melt.

(5) cooling and solidifying the melt poured in the cavity by the cooled mold (at a temperature about 200° C.) to obtain a product.

(6) separating the injector from the mold, opening the halves of the mold and then taking out the molded product;

The product obtained in this manner such as a orifice holder 16 or a valve tappet 19, is divided in the lower solid fraction (threaded portion 18 or thin ring portion 21) to require strength, and the higher solid fraction portion (head portion 17 or thick portion 20) to require molding accuracy.

Figure 3C:
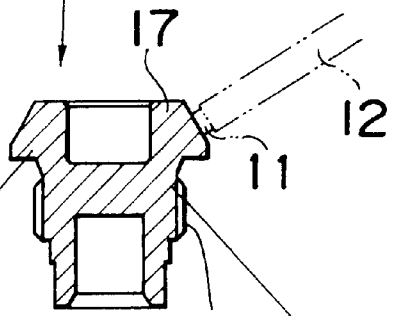
FIG. 3C shows a cross-sectional view of a orifice holder from which the samples for the photographs shown in FIGS. 3A and 3B were taken, where the arrows in this figure indicate the portions sampled.
Figure 3B:
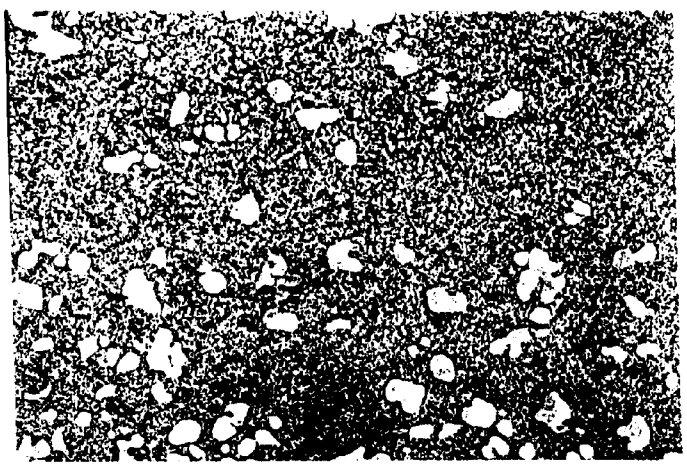
FIG. 3B shows a photograph similar to FIG. 3A, containing about 10% of solid fraction.
Figure 3A:
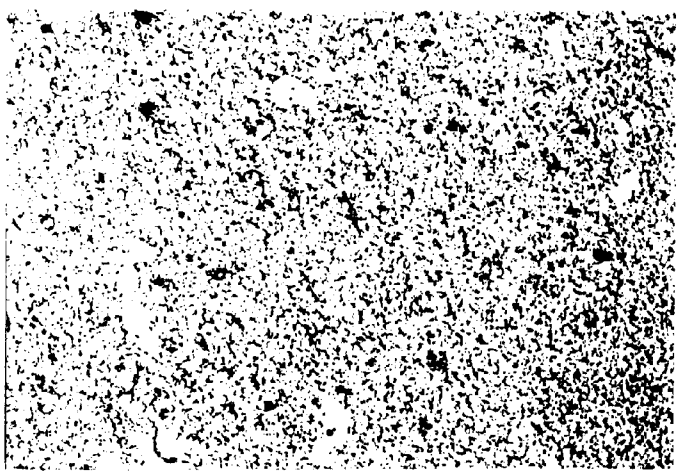
FIG. 3A shows a microscopical photograph of metal structure containing about 2% of solid fraction in a magnesium alloy molded by the method of the invention.

The lower solid fraction to require strength has about 2% of solid fraction and the microscopical photograph of the metal structure of this portion is shown in FIG. 3A. On the other hand, the higher solid fraction to require accuracy has about 10% of solid fraction and the microscopical photograph of the metal structure in FIG. 3B. Those figures shows that magnesium coarse grains (in white in the figures) are in the matrix of the magnesium alloy, and that the higher solid fraction portion (FIG. 3A ) has more magnesium grains than the lower solid fraction portion (FIG. 3B).

The method of the invention can provide the product having the opposite properties of both strength and molding accuracy effectively and simply by injecting the melt with different solid fractions in a semi-molten state on the desired sides of the cavity according to required properties.

This method uses chips of solid metal material which cut of solid material deformed of an magnesium alloy added with strontium previously, the deformation or working of the materials causes the grain size of the solid phase to be fined in the melt and the adding of strontium in the alloy causes the crystal grains of the matrix to be further fined.

As the product is a orifice holder 16, preferably a rear surface of the head portion 17 and a surface of the threaded portion 18 are subjected to shot blasting, being roughened so as to increase friction coefficient on the surface, which prevent from relaxation of the thread portion 18 and reduce residual inner stress of the portion. In the same manner, the effect also is duplicated by shot-blasting a packing 23 so as to coarsen the surface of the packing, as shown in FIG. 2A, which is used to insert between the head portion 17 of the orifice holder 16 and a mission case 22. Furthermore, it is preferable to modify the material of the packing 23 to almost pure aluminum or other temper metals so as to increase friction efficiency of the packing in tight fit.

Also, it is preferable to modify the material of the packing to have the same thermal expansion coefficient as the magnesium or the like, so as to prevent creep deformation due to thermal stress in using a high temperature.

We claim:

1. A method for injection molding a semi-molten melt of metal using an injector to mold a product, comprising steps of:

supplying metal material to a cylinder of the injector;

setting a predetermined temperature distribution in the semi-molten melt of the material in the direction of injection by heating the material in the cylinder, wherein parts of the melt to be injected are determined to be at different temperatures in the injector to compose lower and higher solid fraction parts of the melt; and injecting the semi-molten melt from the cylinder into a cavity of the mold to obtain the product having lower and higher solid fraction portions in the product.

2. A method according to claim 1, wherein a part of the melt to be early injected is determined to be at a lower temperature in the injector than a part of be late injected in the melt parts to compose said higher and lower solid fraction portions, respectively, in the cavity by injecting the batch of the melt, and the melt is injected into the cavity on a side on which said higher fraction portion of the product is formed.

3. A method according to claim 1, wherein a part of the melt to be early injected is determined to be at a higher temperature in the injector than a part to be late injected in the melt parts to compose said lower and higher solid fraction portions, respectively, in the cavity by injecting the batch of the melt, and the melt is injected into the cavity on a side on which said lower fraction portion of the product is formed.

4. A method according to claim 2, wherein as the melt injected, the part of the melt kept in the opening of the nozzle is captured into space in the mold beside the cavity.

5. A method according to claim 2, wherein the melt is in semi-melting state melted of chips cut of solid deformed material of an magnesium alloy containing strontium.

6. A method according to claim 3, wherein as the melt injected, the part of the melt kept in the opening of the nozzle is captured into space in the mold beside the cavity.

7. A method according to claim 3, wherein the melt is in semi-melting state melted of chips cut of solid deformed material of an magnesium alloy containing strontium.

* * * * *